US006281624B1

(12) United States Patent
Koshigoe et al.

(10) Patent No.: US 6,281,624 B1
(45) Date of Patent: Aug. 28, 2001

(54) ELECTRON GUN FOR CATHODE RAY TUBE AND METHOD OF ASSEMBLING THE SAME

(75) Inventors: Shimpei Koshigoe, Fukaya; Syunji Ookubo, Kumagaya, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/309,789

(22) Filed: May 12, 1999

(30) Foreign Application Priority Data

May 13, 1998 (JP) ..... 10-130073

(51) Int. Cl.[7] ..... H01J 29/46
(52) U.S. Cl. ..... 313/451; 446/337; 446/270
(58) Field of Search ..... 313/446, 270, 313/337, 338, 346 R, 346 DC, 340, 341, 378, 390, 451, 456, 37, 412, 414, 426, 281

(56) References Cited

U.S. PATENT DOCUMENTS 5,015,908 5/1991 Miram et al. .
5,444,327 * 8/1995 Treseder et al. ..... 313/337
5,475,281 * 12/1995 Heijboer ..... 313/337
6,130,502 * 10/2000 Kobayashi et al. ..... 313/446

FOREIGN PATENT DOCUMENTS 51-59265 5/1976 (JP) .

* cited by examiner

*Primary Examiner*—Nimeshkumar D. Patel
*Assistant Examiner*—Karabi Guharay
(74) *Attorney, Agent, or Firm*—Oblon, Spivak, McClelland, Maier & Neustadt, P.C.

(57) ABSTRACT

A cathode structure of an electron gun includes a rectangular insulating substrate made of an anisotropically heat decomposable boron nitride, a cathode base mounted on one surface of the insulating substrate with a conductive layer interposed therebetween, and a heater prepared by patterning an anisotropically heat decomposable graphite film formed on the other surface of the insulating substrate. A slit is formed in each of the end portions of the insulating substrate, and the end portions of the insulating substrate are fixed to support members of a holder by ribbons wound on the end portion so the insulating substrate with being passed through the slits.

9 Claims, 6 Drawing Sheets

ELECTRON GUN FOR CATHODE RAY TUBE AND METHOD OF ASSEMBLING THE SAME

BACKGROUND OF THE INVENTION

The present invention relates to an electron gun for a cathode ray tube and a method of assembling the same.

With personalization of computers in recent years, it is desirable to make the display device smaller in thickness and lighter in weight. As a matter of fact, a flat display has already been put to a practical use in a liquid crystal display device, a plasma display, etc. However, these displays are not yet comparable to a cathode ray tube in the size of the display panel, in the fineness and in the manufacturing cost.

For example, an in-line type color cathode ray tube generally comprises an envelope having a panel and a funnel, and an electron gun is arranged within the neck of the funnel. Three electron beams emitted from the electron gun are deflected by a deflecting device mounted on the outside of the funnel and horizontally and vertically scan a phosphor screen formed on the inner surface of the panels through a shadow mask, there by displaying a color picture image on the phosphor screen.

The electron gun includes three cathodes that are linearly arranged, three heaters for heating these cathodes, and a plurality of electrodes, e.g., six electrodes, arranged successively apart from the cathodes. Three electron beams, which are emitted from the cathodes heated by the heaters, are converged on the phosphor screen by an electron lens formed of a plurality of electrodes G1 to G6.

The cathode of a conventional electron gun includes a thin cathode sleeve, a base metal attached to an edge portion of the cathode sleeve on the side of the electrodes, an electron emitting layer formed on the surface of the base metal on the side of the electrodes, a strap attached to the outer circumferential surface of the cathode sleeve, a cylindrical reflector arranged to surround the outer circumferential surface of the cathode sleeve, a cylindrical cathode holder arranged outside the reflector for supporting the cathode sleeve and the reflector via the strap, a support cylinder attached to the outer circumferential surface of the cathode holder, and a support strap attached to the support cylinder.

The heater, which is spirally wound, is inserted into the inside of the cathode sleeve. Both end portions of the heater are attached to a heater tub, and the heater is attached to a heater tub strap via the heater tub. The cathode of the particular construction is supported on a bead glass together with a plurality of electrodes via the heater, the support strap and the heater tub strap.

In the electron gun provided with the cathode-heater portion of the particular construction, the distance between the surface of the electrode G1 on the side of the electrode G2 and the surface of the electron-emitting layer is set at 0.5 mm, the distance between the surface of the electron-emitting layer and the lower end of the cathode holder is set at 9.5 mm, and the distance between the lower end of the cathode holder and the lower end of the heater tub is set at 6.0 mm. Therefore, the entire length of the cathode-heater portion is 16 mm, which is about 30% of the electron gun having an entire length of 50 mm. In other words, the length of the cathode-heater portion occupies a considerably large proportion of the entire length of the electron gun.

In general, the operating temperature of a cathode using an oxide of an alkaline earth metal as an electron-emitting material, i.e., an oxide cathode, is about 830° C., and the heater power for heating the cathode to the operating temperature is 0.7 W. It follows that a heater power of 2.1 W is required in a color cathode ray tube equipped with three cathodes.

It should also be noted that, in an electron gun equipped with the cathode-heater portion of the construction described above, it takes about 10 seconds for the displayed image to be stabilized after supply of the heater power.

To reiterate, in the electron gun included in the conventional cathode ray tube, the cathode-heater portion occupies about 30% of the entire length of the electron gun. Naturally, it is necessary to shorten the cathode-heater portion of the electron gun in order to decrease the entire length of the cathode ray tube in the axial direction of the tube. Needless to say, it is important to decrease the entire length of the cathode ray tube in order to decrease the thickness of the display device.

It should also be noted that a plurality of color TV receivers and personal computers are installed in a single family in recent years, leading to a large power consumption in the family. This makes it important to decrease the heater power of the electron gun.

It is also important to achieve a rapid start-up of a cathode ray tube. In recent years, the color cathode ray tube employs a pre-heating system, with the result that, if a main power source is kept turned on, a predetermined current is kept allowed to flow through the heater. It follows that a stable picture image can be obtained promptly. However, the pre-heating system is not desirable in terms of the power saving. Also, the pre-heating system certainly permits obtaining a stable picture image promptly. However, about 10 seconds are required for obtaining a stable picture image, which is not quite satisfactory.

A cathode-heater structure adapted for overcoming the above-noted problems is disclosed in, for example, U.S. Pat. No. 5,105,908. It is taught that a heater of a predetermined pattern consisting of an anisotropically heat decomposable graphite film is formed on an insulating substrate made of boron nitride that is anisotropically heat decomposable. The heater is thin, i.e., about 1 mm thick, making it possible to decrease the entire length of the cathode-heater structure and to further improve the start-up speed. However, the cathode-heater structure is constructed to be adapted for use in a large and high power electron tube such as a klystron or a traveling-wave tube, but is not constructed to be adapted for use in a small and low power apparatus that can be obtained by mass production such as a cathode ray tube.

BRIEF SUMMARY OF THE INVENTION

The present invention has been contrived in view of the situation described above, and its object is to provide an electron gun for a cathode ray tube, which permits shortening the cathode-heater structure, which is excellent in its power saving, which permits improving the start-up speed, and which is adapted for mass production, and a method of assembling the same.

According to an aspect of the present invention, there is provided an electron gun for a cathode ray tube, comprising: a cathode structure; and a plurality of electrodes arranged in the vicinity of the cathode structure. The cathode structure includes:

a substantially rectangular insulating substrate having a thermal conductivity and a pair of end portions each having a slit formed therein, a cathode base fixed to one surface of the insulating substrate with a conductive layer interposed therebetween, a heater mounted on the other surface of the insulating substrate for heating the cathode base, a support structure supporting the insulating substrate, and a band-like member wound about each of the end portions of the insulating substrate through each of the slits and fixed to the support structure so as to support both end portions of the insulating substrate by the support structure.

In the electron gun of the present invention, the insulating substrate is made of boron nitride that is heat decomposable anisotropically. Also, the heater is formed by patterning an anisotropically heat decomposable graphite film formed on the other surface of the insulating substrate.

Each slit extends in a longitudinal direction of the insulating substrate. Also, the band-like member includes two ribbons wound about the insulating substrate through each of the slits. These ribbons extend from the end portions of the insulating substrate in a direction substantially perpendicular to the longitudinal direction of the insulating substrate.

Alternatively, each slit extends in a width direction perpendicular to the longitudinal direction of the insulating substrate. In this case, the band-like member includes two ribbons wound about the end portions of the insulating substrate through the respective slits and extending from the end portions of the insulating substrate in the longitudinal direction of the insulating substrate.

According to another aspect of the present invention, there is provided a method of assembling an electron gun for a cathode ray tube including a cathode structure having a cathode body and a support structure supporting the cathode body, and a plurality of electrodes arranged in the vicinity of the cathode structure, the cathode body having a high thermal conductivity and including a rectangular insulating substrate, a cathode base fixed to one surface of the insulating substrate with a conductive layer interposed therebetween, and a heater mounted on the other surface of the insulating substrate for heating the cathode base, the method comprising the steps of:

arranging a support base substantially equal in size to the insulating substrate to face that surface of the insulating substrate on which the heater is mounted;

winding a band-like member about each of both end portions in the longitudinal direction of the insulating substrate through a slit formed in each of the both end portions of the insulating substrate and fixing the end portions of the band-like members to both end portions of the support base, respectively; and cutting a central portion of the support base after fixing the band-like members to the support base.

In the electron gun for a cathode ray tube of the particular construction described above and the method of assembling the particular electron gun, a cathode base is formed on one surface of an insulating substrate having a high thermal conductivity, and a heater is mounted on the other surface of the insulating substrate. In addition, slits are formed in both end portions of the insulating substrate. A band-like member is passed through the slit so as to be wound about the insulating substrate. Further, the insulating substrate is fixed to the support structure via the band-like member. The particular construction permits markedly decreasing the entire length of the cathode structure, compared with the conventional cylindrical cathode structure, and also permits saving the heater power and improving the start-up speed of the cathode ray tube. Further, the cathode structure can be manufactured by a method similar to that employed in the manufacture of a semiconductor chip and, thus, is adapted for mass production.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 9 collectively show an in-line type color cathode ray tube according to one embodiment of the present invention, in which:

FIG. 1 is a side view, partly broken away, showing the color cathode ray tube;

FIG. 2 is a cross sectional view schematically showing an electron gun included in the color cathode ray tube;

FIG. 3 is an oblique view showing the cathode structure of the electron gun;

FIG. 4 is a plan view showing the cathode structure;

FIG. 5 is a side view, partly broken away, showing the cathode structure;

FIG. 6 is a plan view showing the cathode body of the cathode structure;

FIG. 7 is a cross sectional view showing the cathode body;

FIG. 8 is a back view showing the cathode structure;

FIG. 9 is a cross sectional view along the line IV—IV shown in FIG. 4;

FIGS. 12 to 14 collectively show a cathode structure of an electron gun according to another embodiment of the present invention, in which:

FIG. 12 is a plan view of the cathode structure;

FIG. 13 is a side view, partly broken away, showing the cathode structure;

FIG. 14 is a plan view showing the cathode body of the cathode structure;

DETAILED DESCRIPTION OF THE INVENTION

A cathode ray tube equipped with an electron gun according to one embodiment of the present invention will now be described with reference to the accompanying drawings.

Figure 1:
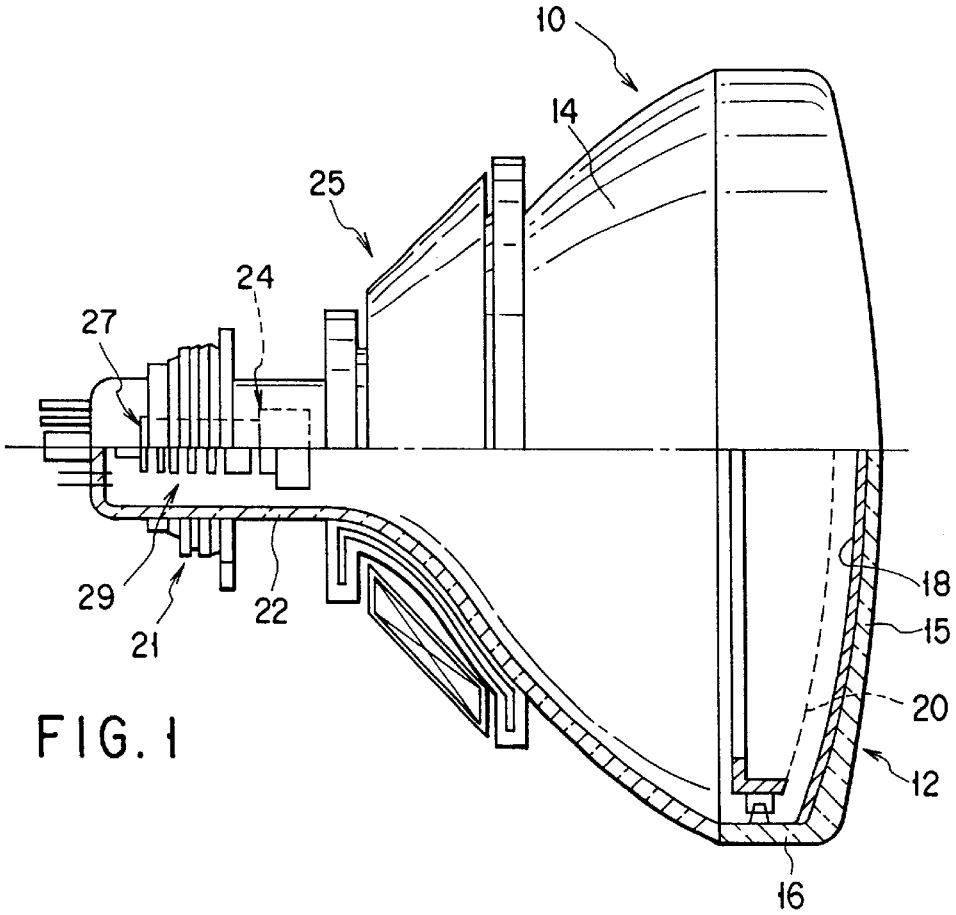

As shown in FIG. 1, a cathode ray tube comprises a panel 12 made of glass and a vacuum envelope 10 having a funnel 14 bonded to the panel 12. The panel 12 includes a substantially rectangular effective portion 15 and a skirt portion 16 erected in the periphery of the effective portion 15. A phosphor screen 18 consisting of a phosphor layer emitting blue, green and red light rays is formed on the inner surface of the effective portion 15 of the panel 12. On the other hand, a substantially rectangular shadow mask 20 is arranged inside the vacuum envelope 10 to face the phosphor screen 18. Further, an in-line type electron gun 24 is arranged within a neck 22 of the funnel 14.

As described herein later, the electron gun 24 comprises a cathode structure that emits electron beams and a plurality of electrodes for controlling, converging and accelerating the electron beams emitted from the cathode structure. A convergence magnet 21 for converging the electron beams is mounted on the outer circumferential surface of the neck 22, and a deflection yoke 25 is mounted on the outer circumferential surface of the funnel 14.

The electron beams emitted from the electron gun 24 are deflected in horizontal and vertical directions by the magnetic field generated from the deflection yoke 25 so as to pass through the shadow mask 20 and, then, strike the phosphor screen 18, thereby forming a desired color picture image.

Figure 2:
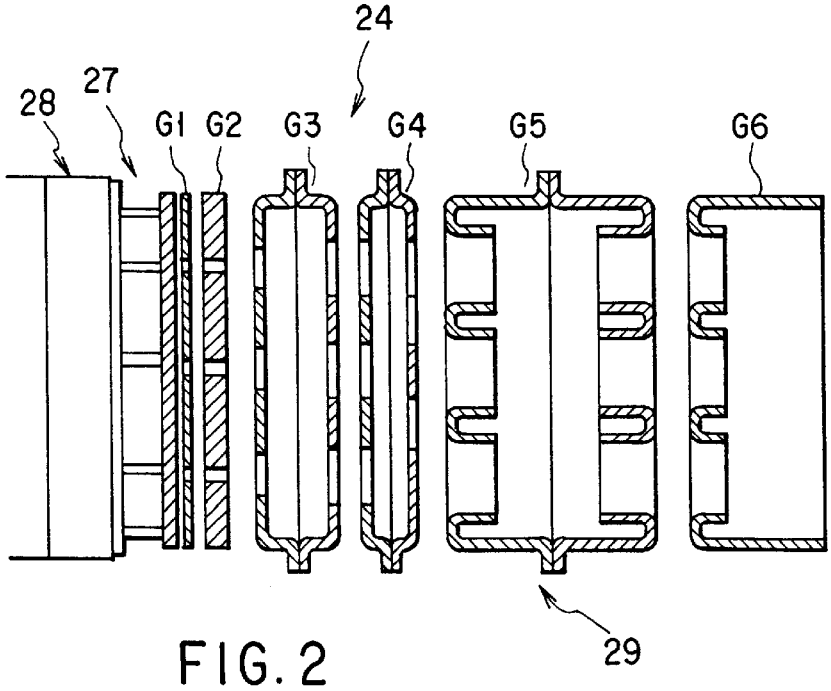

As shown in FIG. 2, the electron gun 24 arranged within the neck 22 comprises a cathode structure 27 having three cathode bases that are linearly arranged and an electrode group 29 including first to sixth electrodes G1 to G6 and arranged in the vicinity of the cathode structure 27.

Each of the first and second electrodes G1 and G2 is shaped like a plate. Each of the third to fifth electrodes G3 to G5 is shaped like a cylinder, and the sixth electrode G6 is shaped like a cup. Each of these electrodes G1 to G6 is provided with three beam-passing holes that are arranged linearly to conform with the three cathode bases of the cathode structure 27.

Figure 3:
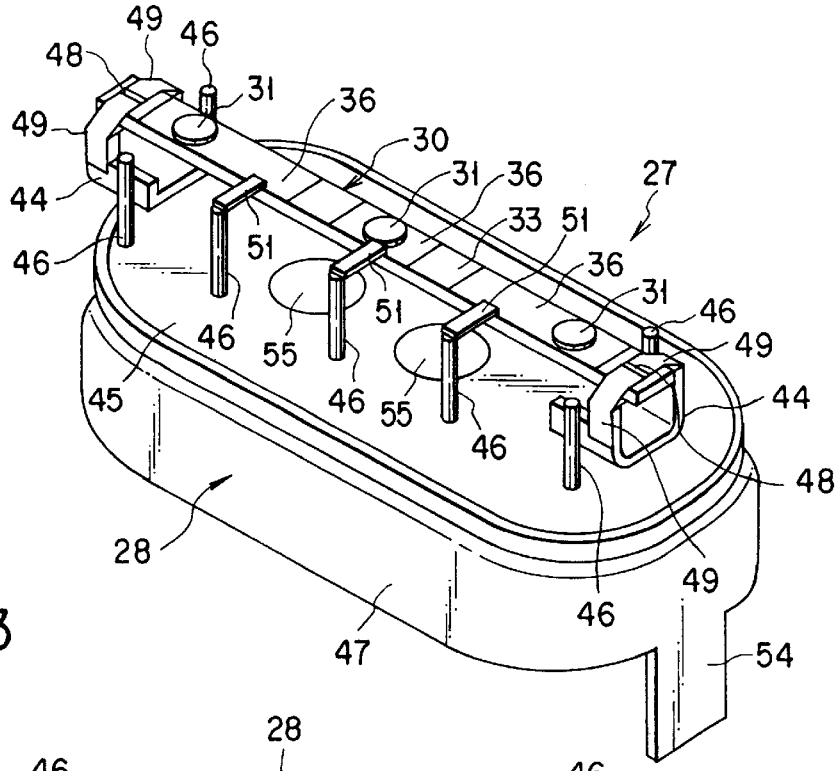
Figure 4:
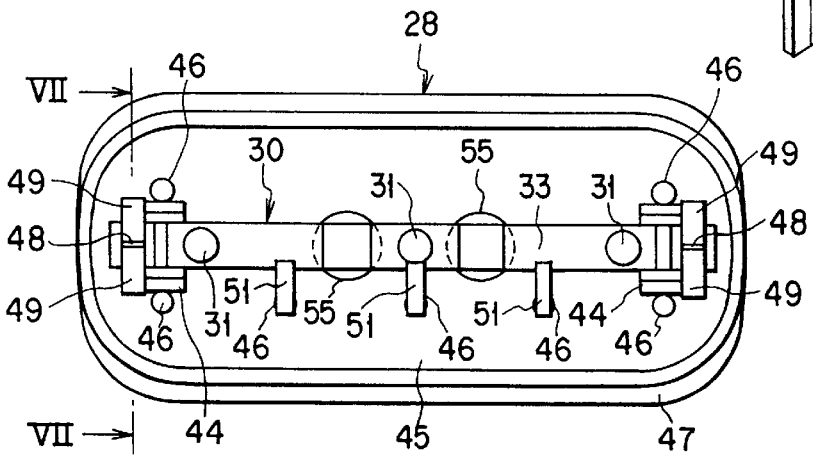
Figure 5:
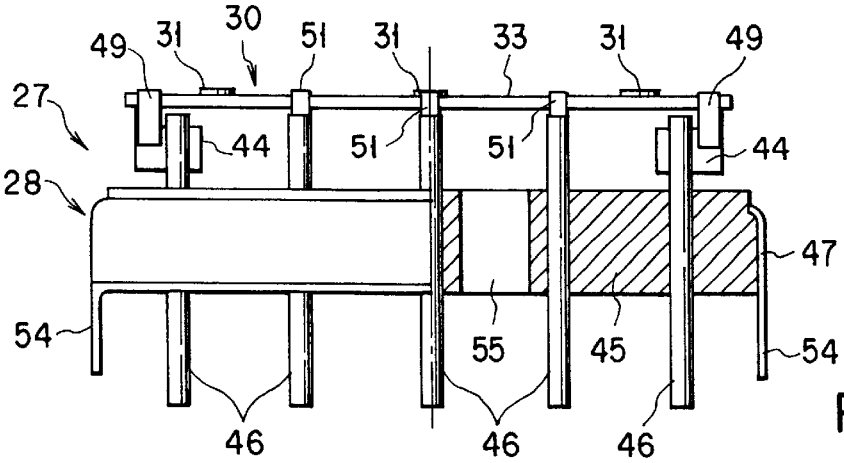
Figure 6:
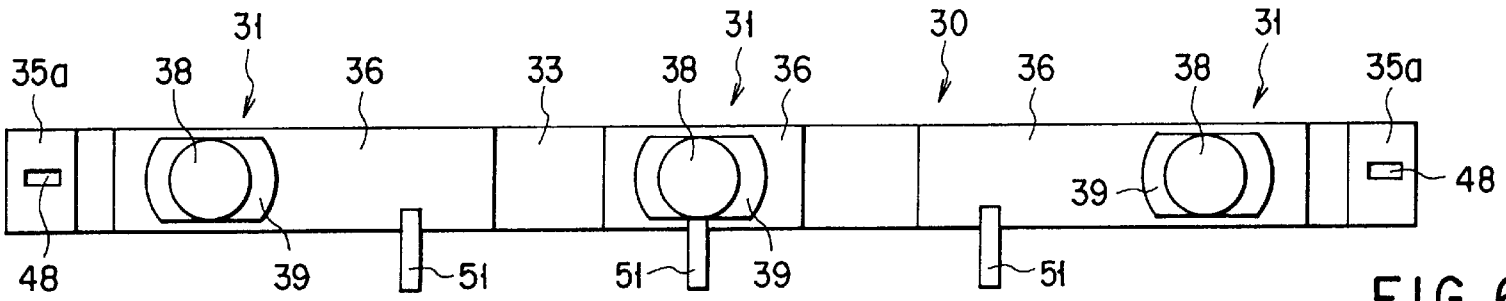
Figure 7:
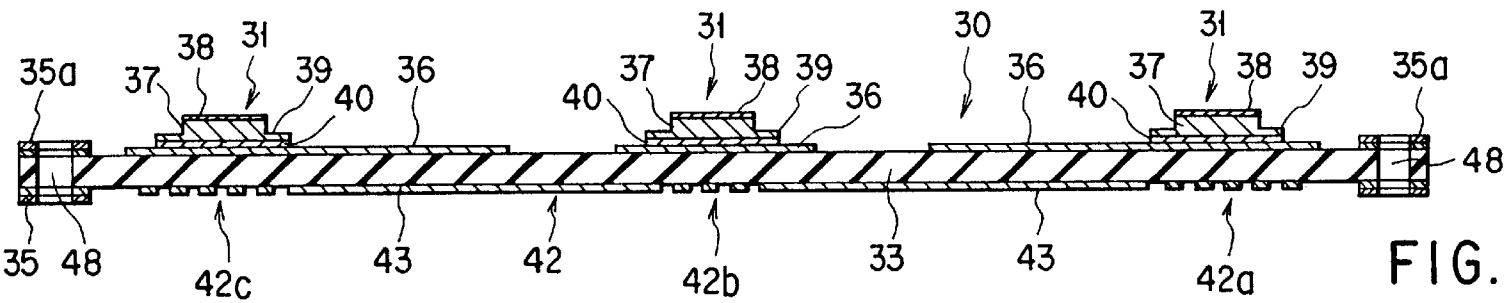
Figure 8:
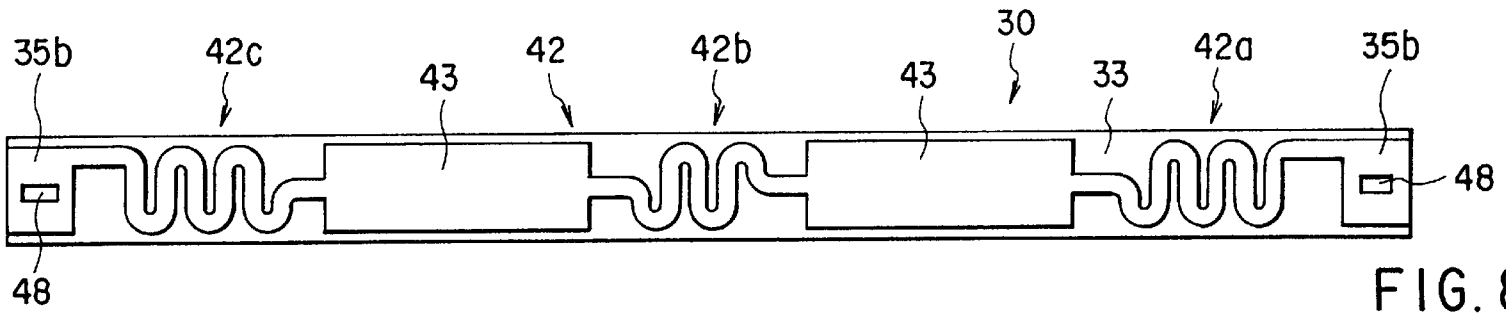
Figure 9:
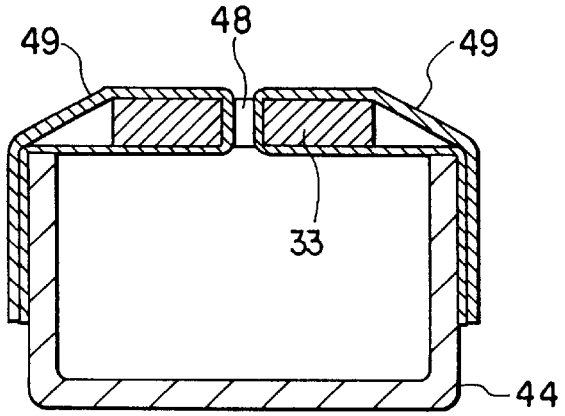

As shown in FIGS. 3 to 5, the cathode structure 27 comprises a cathode body 30 and a holder 28 holding the cathode body 30. As shown in FIGS. 3 to 8, the cathode body 30 includes a slender rectangular insulating substrate 33 made of a heat conductive material, e.g., anisotropically heat decomposable boron nitride (hereinafter referred to as "APBN"). A thick film made of anisotropically heat decomposable graphite (hereinafter referred to as "APG") is formed on one surface, which faces the first electrode G1, of the insulating substrate 33. The thick film is divided into five sections consisting of two heater terminal portions 35*a* positioned in longitudinal end portions of the insulating substrate 33 and three base metal mounting portions 36 located between these heater terminal portions 35*a*.

Three cathode bases 31 of oxide cathode type are mounted on these base metal mounting portions 36 and linearly arranged in the longitudinal direction of the insulating substrate 33. Each cathode base 31 consists of a disk-like base metal 37 made of Ni having a reducing substance added thereto and an electron-emitting substance layer 38 formed on the surface of the base metal 37 and made of an oxide of an alkaline earth metal such as BaO, SrO, or CaO. Incidentally, a flange 39 for mounting the base metal 38 to the base metal mounting portion 37 is formed along the circumferential edge of the base metal 37. The base metal 37 is fixed to the mounting portion 36 with a conductor layer 40 interposed therebetween. To be more specific, the cathode base 31 is fixed to the mounting portion 36 by laser-welding the flange 39 to the conductor layer 40.

A heater portion 42 for heating the cathode base 31 is mounted on the other surface of the insulating substrate 33. The heater portion 42 is formed by patterning the APG film formed on the other surface of the insulating substrate 33. To be more specific, the heater portion 42 includes first to third heating sections 42*a*, 42*b*, 42*c* that generate heat electrically, a pair of non-heating sections 43 each interposed between the adjacent heating sections, and a pair of heater terminal sections 35*b* located at edge portions in the longitudinal direction of the insulating substrate 33.

The first to third heating sections 42*a*, 42*b*, 42*c* are positioned to face the cathode bases 31 with the insulating substrate 33 interposed therebetween and are patterned zigzag. Since the insulating substrate 33 except the portions supporting the cathode bases 31 need not be heated, the pair of non-heating portions 43 and the pair of heater terminal portions 35 are formed to have a large width substantially equal to the width of the insulating substrate 33 so as to suppress the heat generation when an electric power is supplied to the heater portion 42. It follows that the cathode bases 31 are selectively heated efficiently by the first to third heating sections 42*a*, 42*b*, 42*c*.

In the electron gun for a color cathode ray tube, it is necessary to heat the three cathode bases 31 at the same temperature in order to make uniform the electron beams emitted from the three cathode bases 31. Where three cathode bases 31 are linearly arranged on the slender and rectangular insulating substrate 33 as described above, the temperature of the cathode bases at the both ends tends to become lower than the temperature of the central cathode base because of heat conduction. Therefore, the first and third heating sections 42*a* and 42*c* arranged on the end portions in the longitudinal direction of the insulating substrate 33 are formed longer than the second heating section 42*b* positioned in the center so as to make the heat generation from the first and third heating sections 42*a*, 42*c* greater than that from the second heating section 42*b*.

Further, a slit 48 is formed in each of the end portions in the longitudinal direction of the cathode body 30 and extend through the heater terminal portions 35*a* and 35*b*.

On the other hand, the holder 28 acting as a support structure includes a pair of support members 44, a base plate 45 made of a ceramic material, a support frame 47 fixed to the outer circumferential surface of the base plate 45, and seven support pins 46 fixed to the base plate 45 and projecting outward from both surfaces of the base plate 45, as shown in FIGS. 3 to 5. The support frame 47 and the support pins 46 are made of Kovar (KOV) and bonded by a molten glass to the base plate 45 in an electrically insulated state.

The support members 44 each having a U-shaped cross section serve to support both end portions of the insulating substrate 33 on the side on which the heater portion 42 is mounted. Each of the support member 44 is attached to the corresponding end portion of the insulating substrate 33 by a pair of ribbons 49 each made of a material having a small thermal expansion coefficient. To be more specific, as shown in FIGS. 3 to 5 and 9, the pair of ribbons 49, i.e., a band-like member, are wound the end portion of the insulating substrate 33 through the slit 48 formed in the end portion and are withdrawn on both sides of the insulating substrate 33. The pair of ribbons 49 are connected to the heater terminal portions 35*a*, 35*b* and fixed to the both side walls of the support member 44.

Two support pins 46 in each of the end portions of the base plate 45 are welded to the corresponding support member 44 so as to support the cathode body 30 via the support member 44. Also, a heater voltage is applied to the heater portion 42 through the support pins 46, the support member 44, the ribbons 49 and the heater terminal portions 35*a*, 35*b*.

Connection terminals 51 made of nickel are fixed to the base metals 37 of the three cathode bases 31 mounted on one surface of the cathode body 30 or to the base metal mounting portions 36 in a manner to project outward from the cathode body. Three support pins 46 in the central portion are welded to the respective projecting end portions of these connection terminals 51. A cathode voltage is applied from the support pins 46 to the cathode bases 31 through the connection terminals 51 and the base metal mounting portions 36.

The base plate 45, which is formed oblong, is provided with a pair of through-holes 55 for efficiently exhausting the free space between the first electrode G1 and the cathode structure 27 when the inner space within the vacuum envelope is exhausted. The base plate 45 serves to reflect the heat radiated from the heater portion 42 toward the cathode body 30 so as to improve the thermal efficiency of the heater portion. Also, a pair of tongue-shaped portions 54 for fixing the cathode structure 27 to the adjacent first electrode G1 are formed integral with the support frame 47 fixed to the periphery of the base plate 45.

Concerning the specific example of the cathode structure 27 of the construction described above, the insulating substrate 33 made of APBN is shaped rectangular and has a width of 1 mm, a length of 14 mm and a thickness of 0.3 mm. The slit 48 having a width of 0.2 mm and a length of 0.6 mm is formed in each of both end portions of the insulating substrate 33. Each of the APG films formed on both surfaces of the insulating substrate 33 has a thickness of 0.02 mm. The base metal 38 is in the form of a disk having a diameter of 0.8 mm and a thickness of 0.1 mm. The entire thickness of the cathode body 30 including the insulating substrate 33, the base metal 37, the heater portion 42, etc. is 0.5 mm or less. Incidentally, each of the heating sections of the heater portion 42 is set to have a line width of 0.12 mm, and a distance between adjacent lines is set at 0.1 mm.

The base plate 45, which is made of a ceramic material, of the holder 28 is shaped oblong and has a thickness of 2.0 mm. The tongue-shaped portions 54 extending from the support frame 47 have a projecting length of 2.0 mm. Also, each of the support pins 46 projecting in the same direction as the tongue-shaped portions 54 has a projecting length of 2.0 mm. The distance between the base metal 37 and the base plate 45 is 1.5 mm. Further, the entire length (height) of the cathode structure 27 including the first electrode G1 is set at 6.0 mm or less.

The method of assembling the cathode structure 27 of the particular construction described above will now be described.

In the first step, the insulating substrate 33 made of APBN and provided with the slits 48 at both end portions is formed by a chemical vapor deposition (CVD) method, followed by forming thick films of APG by the CVD method on both surfaces of the insulating substrate 33.

In the next step, a photoresist film is formed on the APG film formed on one surface of the insulating substrate 33, followed by patterning the photoresist film by a photo-etching method to form a resist pattern conforming with the heater portion 42. Then, the APG film is selectively removed by a fluorine-based reactive ion etching (RIE) method with the resist pattern used as a mask, followed by removing the resist pattern. As a result, the heater portion 42 is formed on the insulating substrate 33.

Further, the APG thick film formed on the other surface of the insulating film 33 is similarly processed by a photo-etching method to form the heater terminal portions 35*a* and the base metal mounting portions 36.

In the next step, the base metals 37 are attached to the respective base metal mounting portions 36 of the insulating substrate 33. In this case, it is impossible to fix the base metal 37 directly to the base metal mounting portion 36 made of APG. Therefore, the surface of the base metal mounting portion 36 having a thickness of 0.02 mm is coated by a screen printing method with a nickel paste in a thickness of about 0.02 mm, the area of the paste coating being slightly larger than that of the base metal 37. At the same time, each of the heater terminal portions 35*a*, 35*b* is also coated with the nickel paste in the same thickness. Then, the coated nickel paste is dried, followed by heating the paste to 1320° C. under a hydrogen gas atmosphere so as to form a reaction layer between APG and Ni.

Further, the flange portion 39 of the base metal 37 is welded by a laser welding to the reaction layer on the base metal mounting portion 36. Then, the insulating substrate 33 having the base metals 37 welded thereto is fixed to a tool, and the heights of the three base metals 37 are aligned by a lapping treatment.

Figure 10:
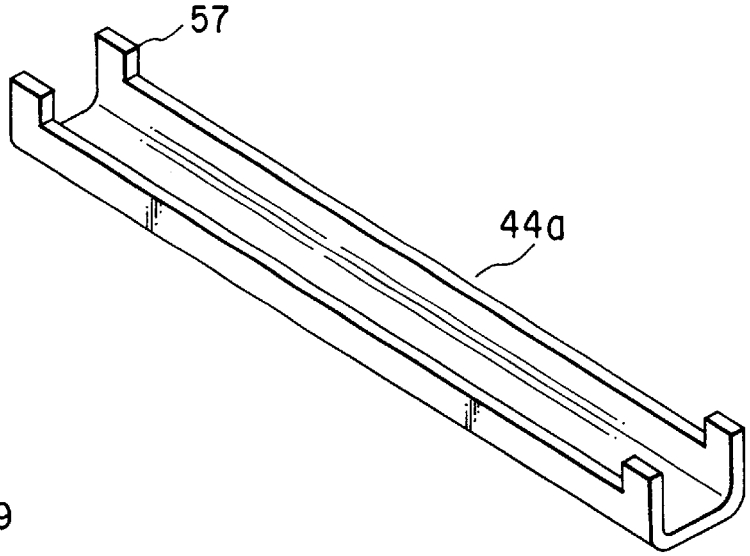
FIG. 10 is an oblique view showing a support base used in assembling the cathode structure.
Figure 11:
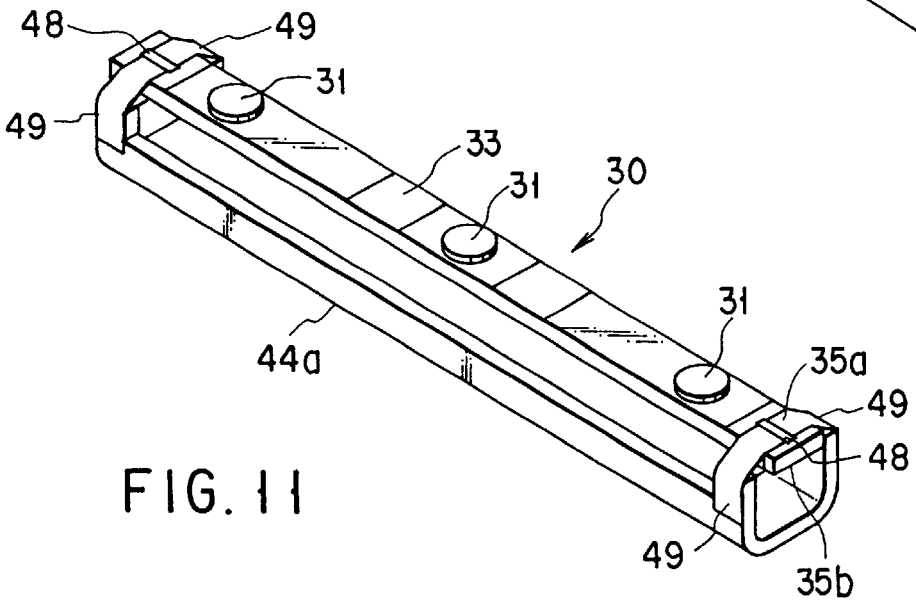
FIG. 11 is an oblique view showing the state that a cathode body has been mounted to the support base.

In the next step, prepared is an elongate support base 44*a* having a U-shaped cross section and having a pair of projections 57 formed in each of the end portions in the longitudinal direction, as shown in FIG. 10. Both end portions of the insulating substrate 33 are supported on the projections 57 of the support base 44*a* by means of ribbons 49. To be more specific, the pair of ribbons 49 are wound on each of the end portions of the insulating substrate 33 with being passed through the slit 48 and welded by a laser welding to the heater terminal portions 35*a*, 35*b* formed on both surfaces of each end portion of the insulating substrate 33, as shown in FIG. 11. The both end portions of these ribbons 49 are also welded to the edge portions of the support base 44*a*.

Then, both end portions of the support base 44*a* are welded to the support pins 46 on the base plate 45 of the holder 28. Under this condition, the central portion of the support base 44*a* is removed by, for example, a laser cutting, with the both end portions of the support base 44*a* left unremoved.

In the next step, the connection terminals 51 are welded to the flanges 39 of the base metals 37 or to the base metal mounting portions 36, followed by welding these connection terminals 51 to the support pins 46 of the base plate 45, as shown in FIG. 3.

Finally, the surface of the insulating substrate 33 except the surface of each base metal 37 is covered with a shielding layer, followed by spraying an electron-emitting substance selected from the group consisting of $BaCO_3$, $SrCO_3$, and $CaCO_3$ against the surface of each base metal 37 so as to form an electron-emitting substance layer, thereby forming the cathode structure 27 as desired.

It should be noted that the cathode structure 27 thus assembled is incorporated inside the first electrode G1 such that a spacer (not shown) regulating a clearance between the first electrode and the cathode structure is arranged on the base plate 45 of the holder 28, and that the tongue-shaped portions 54 of the support frame 47 is welded to tongue-shaped portions formed in the first electrode.

In the cathode structure 27 of the electron gun 24 included in the color cathode ray tube of the construction described above, cathode bases are formed on one surface of the insulating substrate 33 made of APBN and a heater portion is formed on the other surface of the insulating substrate 33.

In addition, the slit 48 is formed in each of the end portions of the insulating substrate, and the ribbons 49 are wound on the end portions of the insulating substrate with being passed through the slits 48, and the insulating substrate 33 is connected to the support pins 26 of the holder 28 by the ribbons. The particular construction of the present invention makes it possible to markedly decrease the entire length of the cathode structure 27, compared with the prior art. Thus, there can be provided an electron gun which is reduced in its entire length and power consumption and improved in the start-up speed, as shown in Table 1 given below. In addition, since the cathode body 30 can be prepared by a method similar to that employed in the manufacture of a semiconductor chip, the electron gun of the present invention can be obtained easily by mass production.

TABLE 1

| | Present embodiment | Prior Art |
|---|---|---|
| length of cathode heater portion | 6 mm | 16 mm |
| lengthh of electron gun | 40 mm | 50 mm |
| heater power | 1.5 W | 2.1 W |
| start-up speed | 5 sec | 10 sec |

In the embodiment described above, the slit 48 extending in the longitudinal direction of the insulating substrate is formed in each of the end portions of the rectangular insulating substrate made of APBN. However, it is possible for the slit 48 to extend in a different direction as in a cathode structure 27 shown in FIGS. 12 to 14.

Figure 12:
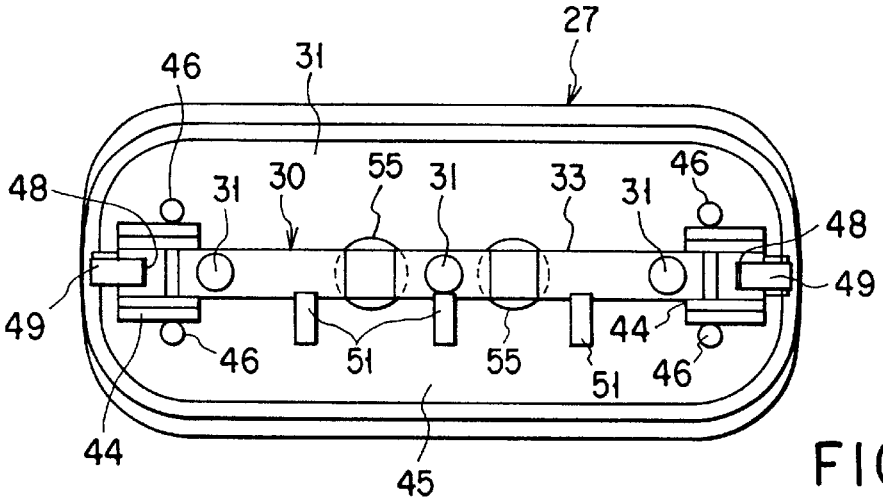
Figure 13:
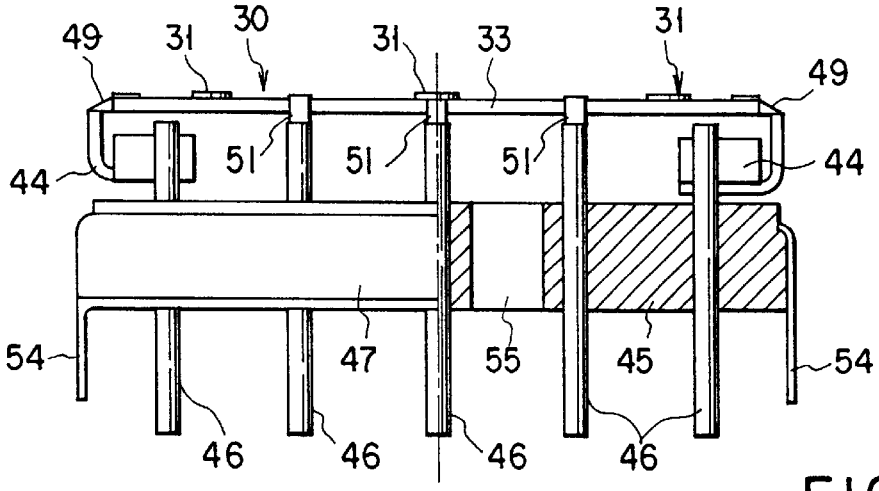
Figure 14:
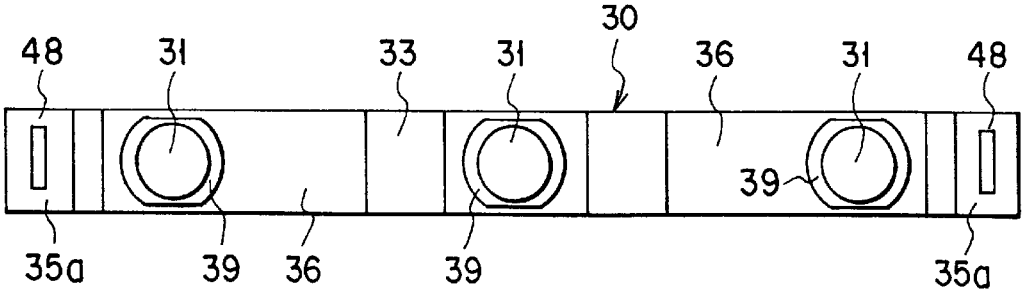
Figure 15:
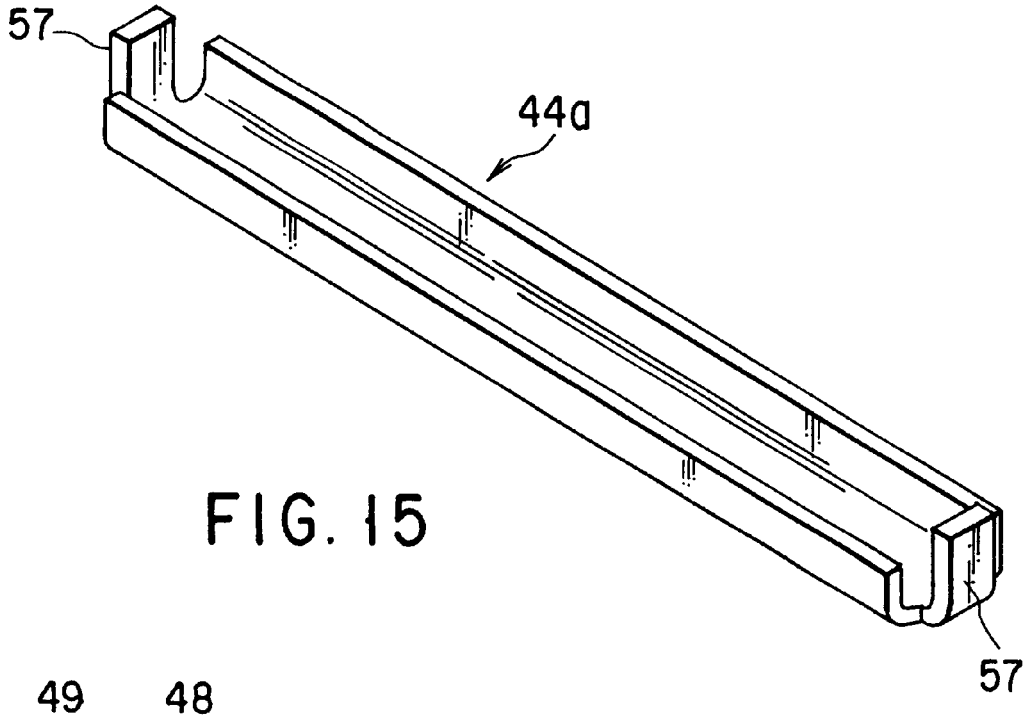
FIG. 15 is an oblique view showing the support base used in assembling the cathode structure according to the another embodiment of the present invention.

To be more specific, in the cathode structure 27 shown in FIGS. 12 to 14, each slit 48 extends in a direction perpendicular to the longitudinal direction of the insulating substrate 33. In this case, a ribbon 49 extending through the slit 48 are withdrawn from the insulating substrate 33 in the longitudinal direction thereof to permit each end portion of the insulating substrate 33 to be fixed to the corresponding support member 44 by a single ribbon 49.

The embodiment shown in FIGS. 12 to 14 is equal to the embodiment described previously in construction other than the cathode structure 27 and, thus, the common portions are denoted by the same reference numerals to avoid an overlapping description.

Figure 16:
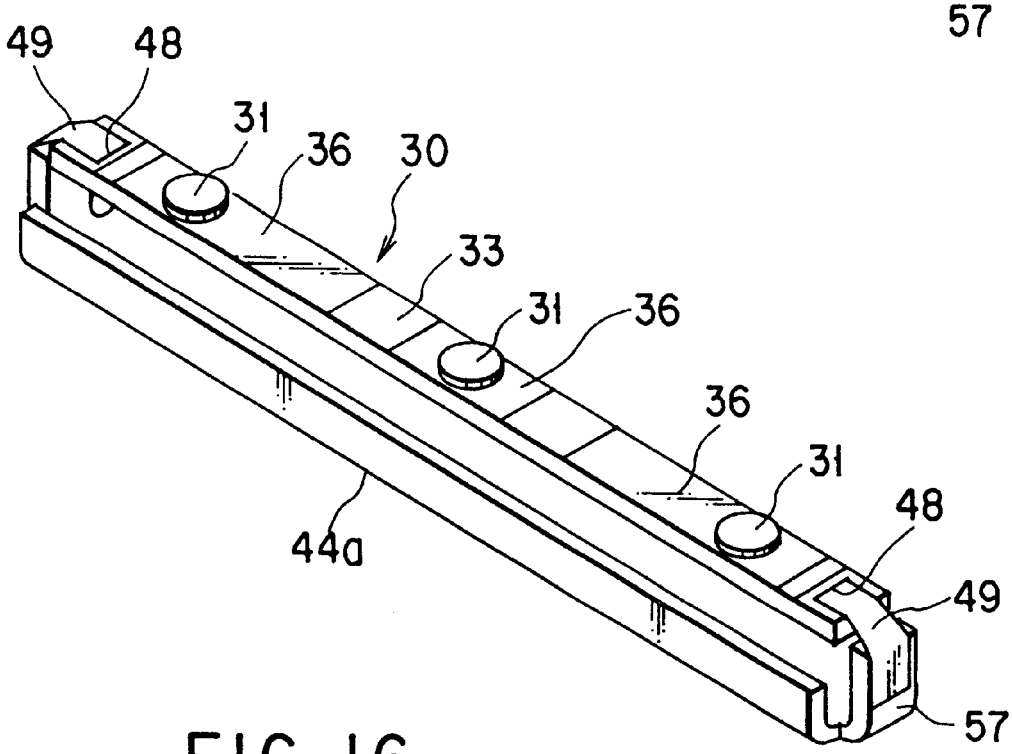
FIG. 16 is an oblique view showing the state that the support base has been mounted to the cathode body in the another embodiment.

In assembling the cathode structure 27, a support base 44*a* having a U-shaped cross section and provided with projections 57 at both end portions is prepared, and a pair of ribbons 49 withdrawn in the longitudinal direction of the insulating substrate 33 are welded to the projections 57 at the both end portions of the support base 44*a*, as shown in FIG. 16.

The cathode structure of the particular construction also enables the electron gun to produce the effects similar to those produced by the electron gun described previously.

The present invention is not limited to the embodiments described above and can be modified in various fashions within the technical scope of the present invention. For example, in each of the embodiments described above, tongue-shaped portions are provided at the support frame of the holder and welded to tongue-shaped portions of the first electrode so as to fix the cathode structure to the first electrode. However, it is also possible to incorporate the cathode structure inside the first electrode, followed by pressing a retainer against the back surface of the base plate and subsequently welding the retainer to the first electrode so as to fix the cathode structure to the first electrode. In this case, the holder can be made shorter by about 1 mm than that in the cathode structure in each of the embodiments described above, thereby further decreasing the entire length of the electron gun.

It should also be noted that, if a reflective metal film is formed on that surface of the base plate of the holder which faces the heater portion of the cathode body, the heat radiated from the heater portion can be more effectively utilized for the heating of the cathode bases, making it possible to save the heater power.

The technical idea of the present invention can be applied not only to the electron gun for a color cathode ray tube but also to the electron gun for other types of a cathode ray tube, with substantially the same effects.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electron gun for a cathode ray tube, comprising:

a cathode structure; and a plurality of electrodes arranged in the vicinity of the cathode structure;

the cathode structure including:

a substantially rectangular insulating substrate having a thermal conductivity and a pair of end portions each having a slit formed therein, a cathode base fixed to one surface of the insulating substrate with a conductive layer interposed therebetween, a heater mounted on the other surface of the insulating substrate for heating the cathode base, a support structure supporting the insulating substrate, and a band-like member wound about each of the end portions of the insulating substrate through each of the slits and fixed to the support structure so as to support both end portions of the insulating substrate by the support structure.

2. An electron gun according to claim 1, wherein the insulating substrate is made of an anisotropically heat decomposable boron nitride, and the heater has an anisotropically heat decomposable graphite film formed on the other surface of the insulating substrate and patterned in a predetermined shape.

3. An electron gun according to claim 2, wherein the heater includes a heating section positioned to face the cathode base with the insulating substrate interposed therebetween and heater terminals positioned at the end portions of the insulating substrate, and the support structure is provided with a plurality of support pins electrically connected to the heater terminals through the band-like members.

4. An electron gun according to claim 2, wherein the cathode structure includes a plurality of cathode bases mounted on the insulating substrate with the conductive layer interposed therebetween, and the heater includes a plurality of heating sections positioned to face the cathode bases with the insulating substrate interposed therebetween and heater terminal portions positioned at both end portions of the insulating substrate.

5. An electron gun according to claim 1, wherein each of the slits extends in the longitudinal direction of the insulating substrate.

6. An electron gun according to claim 5, wherein each of the band-like members includes two ribbons passing wound on the corresponding end portion of the insulating substrate and being passed through each of the slits and extending from the corresponding end portion of the insulating substrate in a direction substantially perpendicular to the longitudinal direction of the insulating substrate.

7. An electron gun according to claim 1, wherein each of the slits extends in a width direction perpendicular to the longitudinal direction of the insulating substrate.

8. An electron gun according to claim 7, wherein each of the band-like members includes a ribbon wound on the corresponding end portion of the insulating substrate and being passed through each of the slits and extending from the end portion of the insulating substrate in the longitudinal direction of the insulating substrate.

9. An electron gun according to claim 1, wherein the support structure includes an insulating base plate positioned to face the heater, a plurality of support pins extending from the base plate, and a pair of support members positioned at the end portions of the insulating substrate and fixed to the support pins, and the band-like members are fixed to the respective support members.

* * * * *

UNITED STATES PATENT AND TRADEMARK OFFICE

CERTIFICATE OF CORRECTION

PATENT NO. : 6,281,624 B1
DATED : August 28, 2001
INVENTOR(S) : Koshigoe et al.

It is certified that error appears in the above-identified patent and that said Letters Patent is hereby corrected as shown below:

Title page, Item [54], and Column 1, lines 1-2,
The title should be:
-- [54] ELECTRON GUN FOR A CATHODE RAY TUBE HAVING SPECIFIC CATHODE STRUCTURE --

Signed and Sealed this

Twenty-third Day of April, 2002

*Attest:*

*Attesting Officer*

JAMES E. ROGAN
*Director of the United States Patent and Trademark Office*